US005409300A

United States Patent [19]

Bourgoin

[11] Patent Number: 5,409,300

[45] Date of Patent: Apr. 25, 1995

[54] MECHANIZED SCALING BAR

[76] Inventor: Claude Bourgoin, 2737 Valcourt, Sainte-Foy, Quebec, Canada, G1W 1V9

[21] Appl. No.: 200,718

[22] Filed: Feb. 23, 1994

[51] Int. Cl.[6] ..... E21C 3/04; E21C 37/26

[52] U.S. Cl. ..... 299/69; 173/90; 299/94

[58] Field of Search ..... 299/69, 70, 94; 125/40, 125/43; 173/90, 91

[56] References Cited

U.S. PATENT DOCUMENTS

| | | | |
|---|---|---|---|
| 1,858,518 | 5/1932 | Newbaker | 299/94 |
| 2,359,213 | 9/1944 | Gardner | 299/94 X |
| 3,036,482 | 5/1962 | Kenworthy et al. | 173/90 |
| 3,619,009 | 9/1971 | O'Leary | 299/91 |
| 4,871,214 | 10/1989 | Pradelle | 299/69 |
| 5,180,210 | 1/1993 | Lister | 299/70 |

*Primary Examiner*—David J. Bagnell

[57] ABSTRACT

A portable mechanized scaling bar for the dislodging of unstable rocks in the galleries of subterranean mines provided with a telescopic handle of one (1) to two (2) meters in length terminated by a periodic displacement hitting piston, and a scaling tool adapted to the handle and comprising an anvil with a first longitudinal axis in line with the handle and having a penetrating portion including a point with a circular section, an angular stem with a convex back and concave face, an S-shape connecting the stem with an elongated anvil wherein when the point is displaced axially between rocks a lever is formed for dislodging the rocks. This tool generates a lever effect while penetrating between unstable rocks and rapidly dislodges them while minimizing efforts by the operator.

15 Claims, 8 Drawing Sheets

MECHANIZED SCALING BAR

FIELD OF THE INVENTION

This invention is related to the field of rock scaling in mines, and more particularly, to a mechanized scaling bar.

BACKGROUND OF THE INVENTION

Rock scaling in a mine is an operation that consists in the probing, with a steel bar, of the walls of a gallery in a subterranean mine, the goal being to locate and remove unstable rocks, a possible cause of accidents. Nowadays, this operation is done manually and is, in itself, dangerous. The maneuvering of such a steel bar requires a lot of energy (the bar weighs around 11 lbs) which increases the risks of injuries due to mishandling of the bar, due to using an improper bar and proceeding to an incomplete scaling operation.

U.S. Pat. No. 5,180,210 Lister, Jan. 19, 1993, shows a tool having at one end a chisel 64 (FIG. 1) provided with a part 65 aligned and connected to a piston to reciprocate with the piston in response to high pressure air delivered to the cylinder. The chisel has a cutting edge which is offset from the axis of the piston to facilitate the chiseling of obstructions inside a chimney. The tool is created to provide a cutting action without any lever effect. If it were so the chisel, having a wedging sharp edge in place of a cutting edge, could damage the interior of the chimney.

U.S. Pat. No. 4,871,214 Pradelle, Oct. 03, 1989, illustrates a device for removing boulders loosened by an explosion from the hanging roof of a mining gallery. The tool works by vibrating the rocks with an especially designed head 11 (FIG. 2) the head having the shape of a torus. With this method, rock will slacken until it eventually falls. The tool has no levering capability.

U.S. Pat. No. 3,619,009 O'Leary, Nov. 09, 1971, shows the tip 13, bent in an "L" shape, of another type of scaling tool. The curve facilitates the work of the operator during the penetrating action of the tip of the tool into cracks in the rock. However, the lever effect is due to human effort, the operator having to push on the handle of the tool perpendicularly against the rock and lift the tool by moving the tool parallel to the surface of the rock to remove the stones. Moreover the tip does not have a shape facilitating the penetrating and wedging action of the its point.

OBJECTIVES OF THE INVENTION

A general objective is to provide a mechanized scaling bar fitted with a tool for the removal of unstable rocks from the walls of a gallery in a subterranean mine thereby constituting an improvement over existing systems to facilitate the work and increase the safety of the operator of the bar.

The first objective of this invention is to provide a mechanized scaling bar allowing the combination of the axial and radial forces of the tool to mechanically generating a lever effect to dislodge unstable rocks and minimize the flexing efforts done by the operator.

The second objective of the invention is to provide a scaling bar that is ergonomic, light and portable, thus reducing the efforts made by the operator while minimizing the risks of accident related to the operation in itself.

A third objective of this invention is to provide a scaling bar allowing the operator to scale at a safe distance and angle by the lengthening (or shortening) of a telescopic handle to the appropriate length for a given scaling operation.

A fourth objective of this invention is to provide a scaling bar with means to deviate rocks detaching themselves from the walls far from the hands and feet of the operator and to provide means of protection from the pneumatic hammer of the scaling bar, making the operation even safer.

A fifth objective of the invention is to provide means for controlling the power on and off of the tool and also to provide a handling system that is supple, flexible and easy to use.

A sixth objective is to provide a scaling bar fitted with a tool having a point facilitating positioning into cracks, thus augmenting the effectiveness of the scaling action.

A seventh objective is to provide means to reduce the vibration transmitted by the scaling bar to the operator during the scaling operation and to provide a good hold along its total length.

An eighth objective of the invention is to combine the angle of the back of the tip of the tool, the angle of the internal face relative to the axis of the handle, and the penetrating tip of the tool into a crack in a way to mechanically form a lever action, by the sole displacement, by way of a piston, of the tip and the back of the tool, which is circumferentially larger relative to the tip of the tool, the arms of the operator allowing at most an immediate disengagement of the unstable rock without any significant displacing of the operator's body.

A general objective is to provide a portable (lightweight), mechanized (pneumatic) scaling bar that is telescopic, ergonomic and having a tool adapted with a point that generates a lever action without any flexing effort from the operator, thus augmenting the effectiveness of and the quality of the scaling action while reducing risks of accidents.

Further aspects of the invention will appear as the description proceeds.

DESCRIPTION OF THE INVENTION

Figure 1:
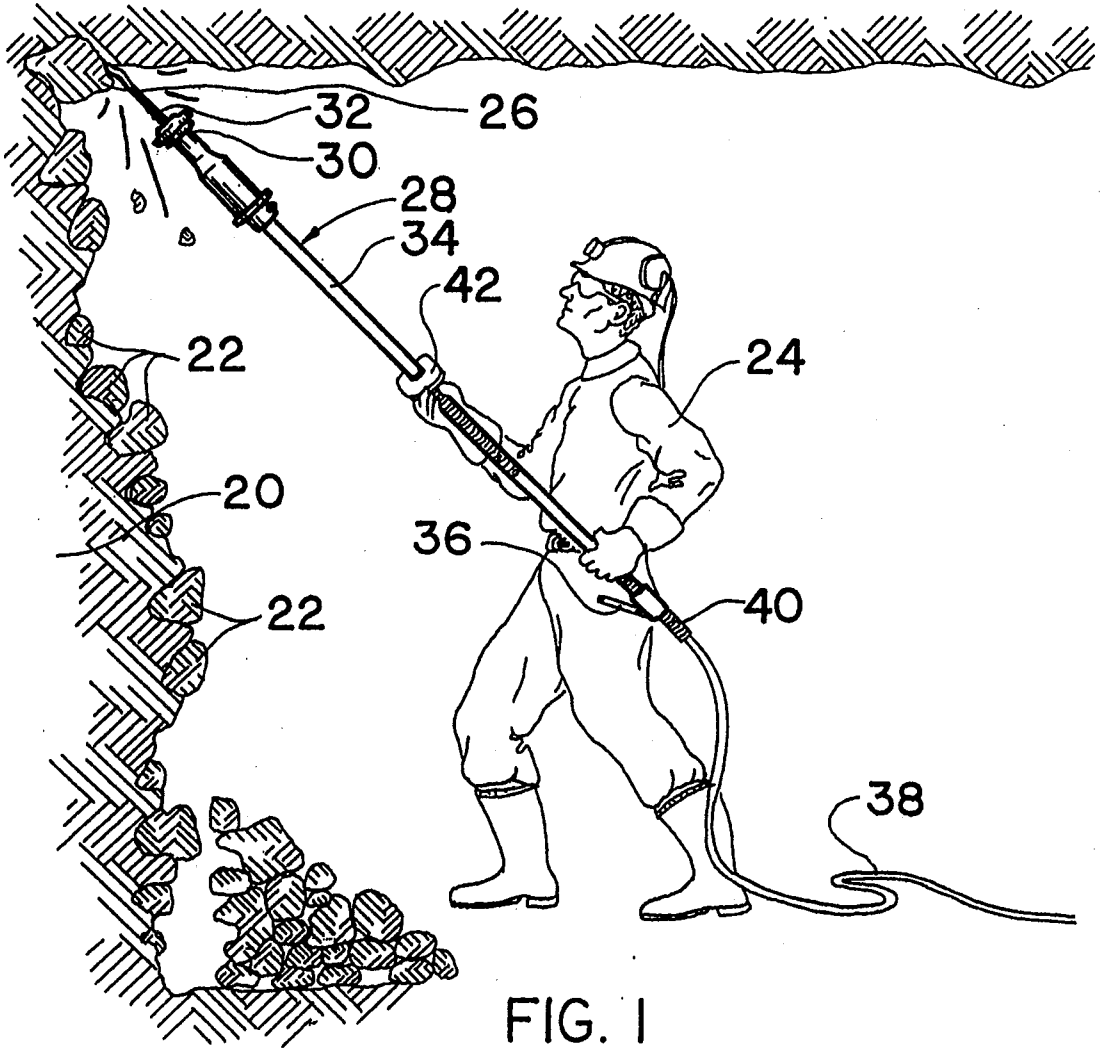
FIG. 1 is a perspective view of an operator using the mechanized scaling bar.

By referring to the figures, the components can be identified by like numbers on all figures, where one can see on FIG. 1 a gallery 20 in mine comprising a plurality of unstable rocks 22. An operator 24 disengaging an unstable rock 26 with the help of a mechanized scaling bar 28 comprising an impact device 30 acting on a scaling tool 32. The impact device 30 comprises a telescopic handle 34 adapted with a trigger 36, the telescopic handle 34 being connected to a source of compressed air by a hose 38. An adaptor 40 connects telescopic handle 34 to hose 38 and a guard ring 42 protects the operator's hand.

Figure 2:
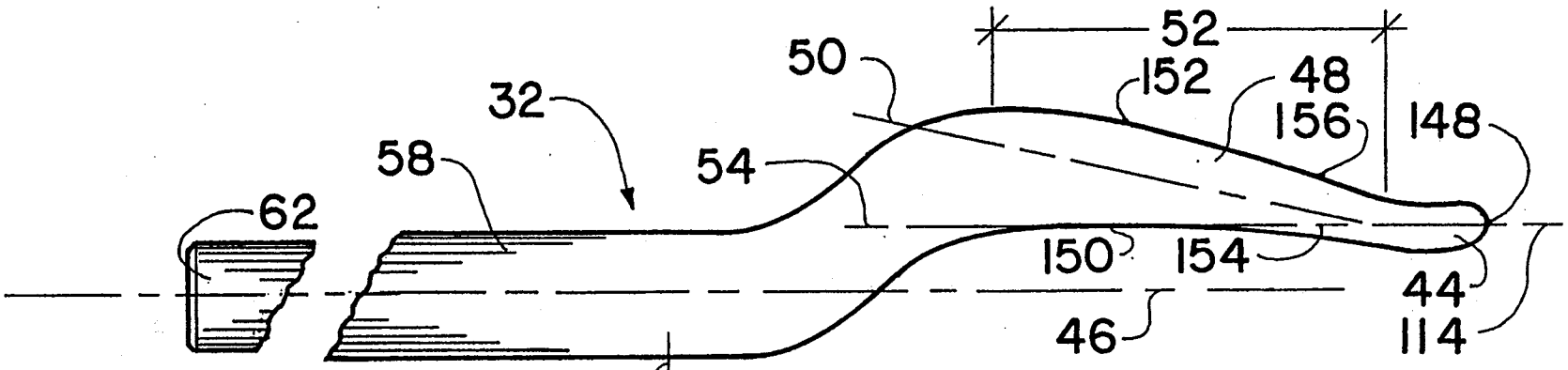
FIG. 2 is a side view of the tip of the tool.
Figure 3:
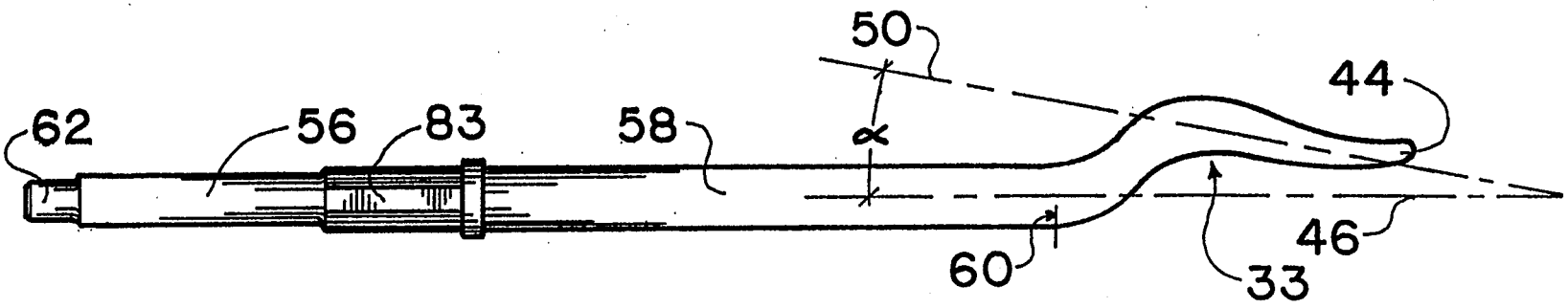
FIG. 3 is a side view of the tool.
Figure 4:
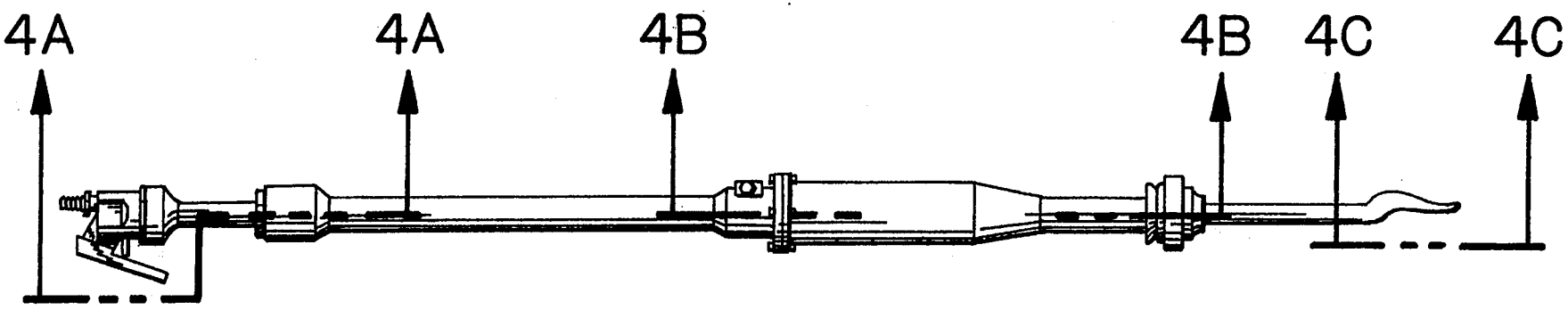
FIG. 4 is a side view of a mechanized scaling bar.
Figure 4A:
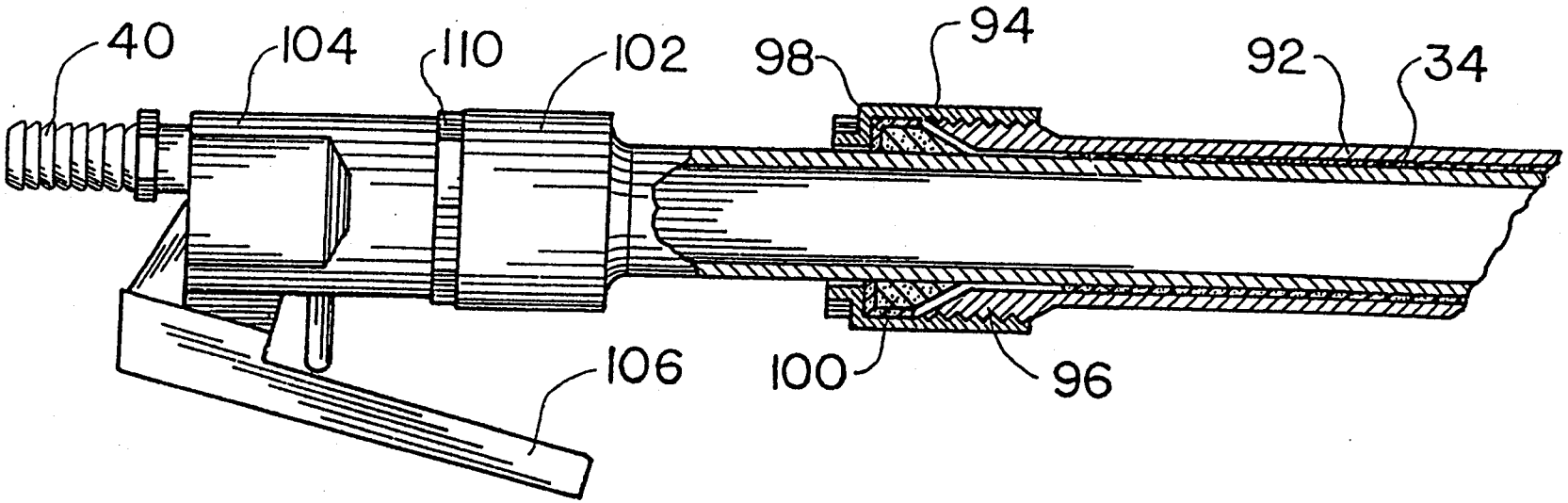
FIG. 4A is a partial cut view according to line 4A—4A of FIG. 4.
Figure 4B:
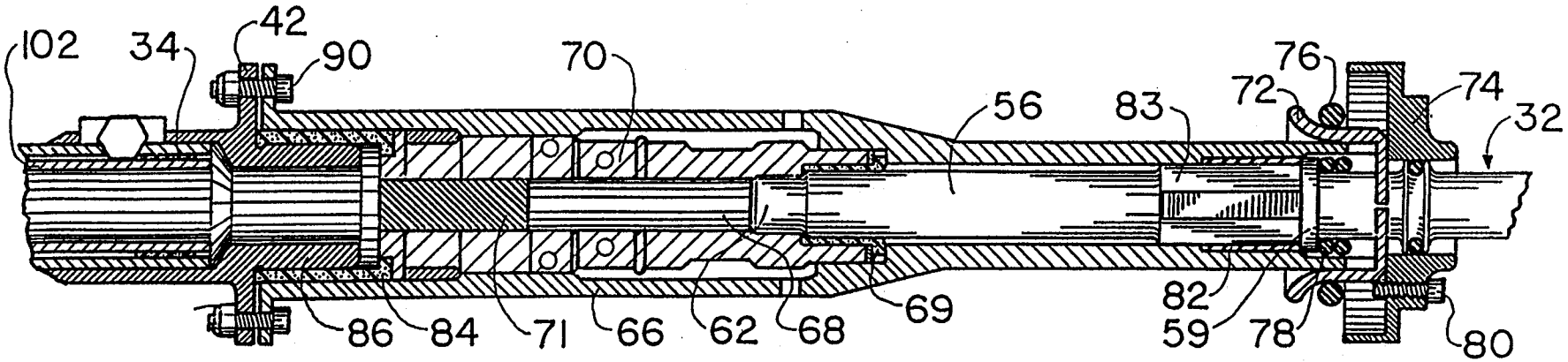
FIG. 4B is a partial cut view according to line 4B—4B of FIG. 4.
Figure 4C:
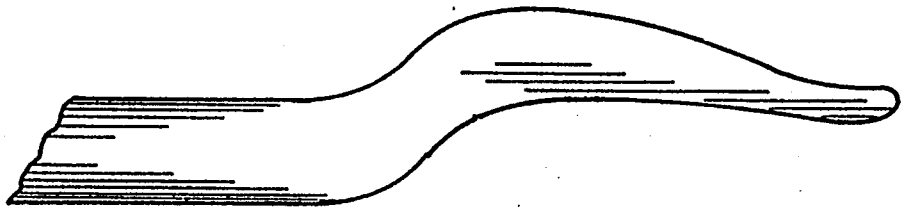
FIG. 4C is a partial cut view according to line 4C—4C of FIG. 4.

The scaling bar is adapted with a scaling tool 32 (FIG. 2) featuring an S-shape 54 aligned with a first longitudinal axis 46 of an elongated body 58 (FIG. 3), a portion a penetration point 44 with a second longitudinal axis 114 offset by by a distance equivalent to half of the diameter of the elongated body 58 and parallel to the first longitudinal axis 46 of an elongated body 58 (FIG. 3), an angular stem 48 (FIG. 2) possessing a third axis 50, a length 52 and two sides, the S-shape 54, the core of which is at a 45° angle relative to the first longitudinal axis 46, an anvil 56 (FIG. 3) that forms the rear part of the elongated body 58 that is also adapted with an abutting ring 59, a hit end 62 (FIG. 2) that receives the impacts from a mechanical hammer, preferably a pneumatic hammer 70 (FIG. 4B), and a junction end 60 (FIG. 3) that coincides with the end of the elongated S-shape 54. The hit end 62 of the anvil 56 is to be inserted in the top part of the primary adaptor 66 (FIG. 4B) up to the vestibule 68 of the pneumatic hammer 70. The scaling tool 32 is attached by a split stop ring 72, a retaining O-ring 76, a retaining coupling 74, two cushioning O-rings 78, while a bolt 80 fixes retaining coupling 74 to the primary adaptor 66. The elongated body 58 (FIG. 3) of the scaling tool 32 is circled by a wear ring 82 (FIG. 4B) having an hexagonal shape, this shape having for object to prevent the rotation of the hexagonal section 83 (FIG. 3) of the anvil 56; the hexagonal wear ring 82 serving as a guide and aligning the longitudinal vibrating movement of the point 44 of the scaling tool 32. The hit end 62 is surrounded by and slides in a bushing 69 (FIG. 4B) of the hammer and moves in a vestibule 68 of the body of the hammer where it is in contact with the piston 71 and receives the impact.

The pneumatic hammer 70 is fastened into the primary adaptor 66 with a nut 84 that pushes it on an interior bushing 86. A guard ring 42 welded to telescopic handle 34 connects the primary adaptor 66 and the telescopic handle 34 itself by means of a bolt 90. The telescopic handle 34 comprises a fixed exterior handle 92 and an inner telescopic sleeve 102. This inner telescopic sleeve 102 is adapted with a pneumatic control 104 actioned by the trigger 36, the control being fastened by a thread and secured by a stop ring 110.

The inner telescopic sleeve is also adapted with an inner locking mechanism 94 comprising a screw on ring 96, an O-ring 98, a tapered piece of soft rubber 100, which screws on the fixed exterior handle and fixes the inner telescopic sleeve at the desired position.

An adaptor 40 connects the rear portion (FIG. 1) of the mechanized scaling bar 28 to a tank of compressed air by means of hose 38.

Figure 5:
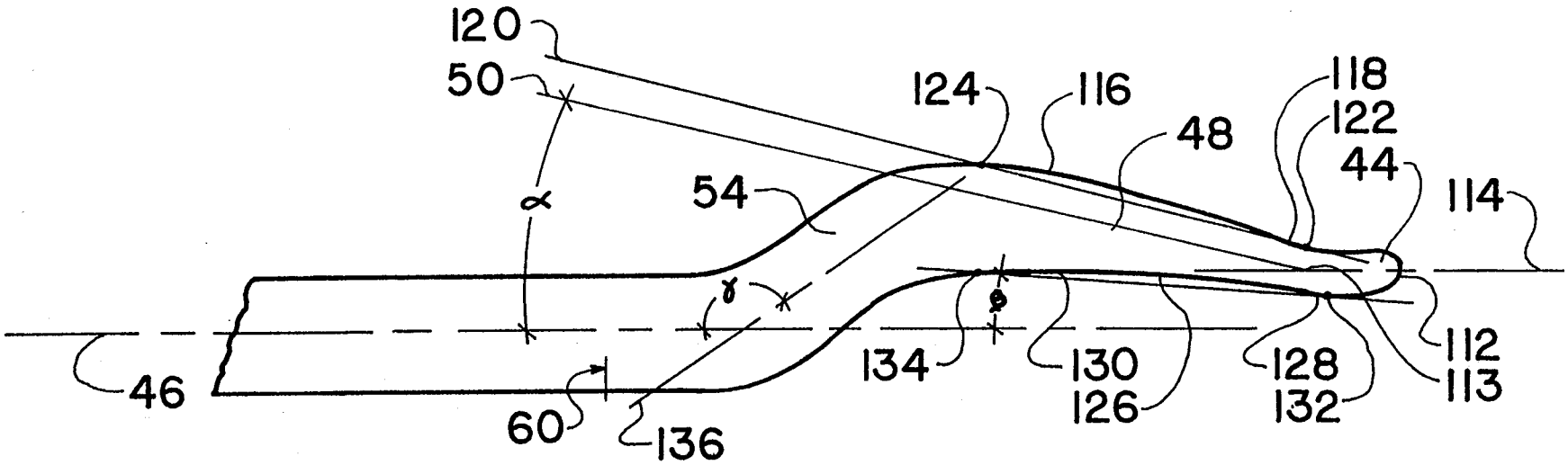
FIG. 5 is an enlarged side view of the tip of the tool.

The scaling tool 32 (FIG. 5) comprises a penetration point 44 having an end extremity 112 with a second longitudinal axis 114 offset and parallel to the first longitudinal axis 46 passing through the handle of the tool, an angular stem 48 having an exterior surface forming a convex back 116 to the tool and connected by concave portion 118 to the penetration point 44, the back forming, between a straight line 120, passing by two points 122 and 124 respectively located on the concave portion 118 and on the convex back 116 of the angular stem 48, and the second longitudinal axis 114 which is parallel to the first longitudinal axis 46 of the handle of the tool, a support angle $\alpha$ between 10 and 30 degrees, preferably about 15 degrees. Furthermore an inferior surface forming a concave face 126 of the tool comprising a lightly convex portion 128 connected to the penetration point 44 followed by a concave portion 130, the face 126 forming between a right line, passing by two points 132 and 134 respectively located on convex portion 128 and on concave portion 130 of face 126, and the first longitudinal axis 46 of the handle of the scaling bar defines a clearance angle $\beta$ between 0 and 12 degrees, preferably about four (4) degrees. The support angle $\alpha$ being wider than the clearance angle $\beta$, brings about a widening of the angular stem 48 thus causing a wedging action with convex back 116 acting as a wedge and concave portion 130 offering a clearance, the concave portion 130 of face 126 corresponding to the convex back 116. The S-shape 54 provides a curved portion having a fourth axis 136 forming an angle $\tau$ preferably around 135 degrees with first longitudinal axis 46 passing by the handle of the tool, that is an angle $\tau$ wider than 90° bringing the S-shape 54 within the first longitudinal axis 46 of the handle of the tool.

In summary the scaling tool 32 (FIG. 1) for the removing of unstable rocks comprises:

—an anvil 56 (FIG. 3) comprising an elongated body 58 along a first longitudinal axis 46 and two extremities, the elongated body adapted to be displaced longitudinally with non-rotative means for sliding, —a penetrating portion 33 (FIG. 2) comprising a penetration point 44, an angular stem 48 and an S-shape 54, the penetration point 44 comprising a second longitudinal axis 114 and two ends, the angular stem 48 comprising a third axis 50, a length 52 and two sides, the S-shape 54 between junction end 60 and the start of the angular stem 48 being elongated, —means for periodic displacement acting on the anvil 56, —the end extremity 112, usually wedge-shaped, (FIG. 5) of the penetrating point being directed axially 114 toward unstable rocks, the second extremity 113 being connected along a primary angle $\alpha$ in a concave manner 118 to angular stem 48, a first surface of the stem substantially forming a back 116, convex, acting as a wedge relatively to the primary axis 114 and a second surface forming a concave face 126 directed toward the first longitudinal axis 46 according to an angle $\beta$ and where angle $\beta$ is smaller than angle $\alpha$; the angular stem 48 being followed by the S-shape 54 up to the junction end 60 of the elongated body 58 (FIG. 3), the hit end 62 of the anvil being a means to receive an axial displacement, in a manner such that the displacement of the anvil, the S-Shape, the angular stem and the tip point cause the penetration between the rocks and the lever action removing the rocks.

Figure 6:
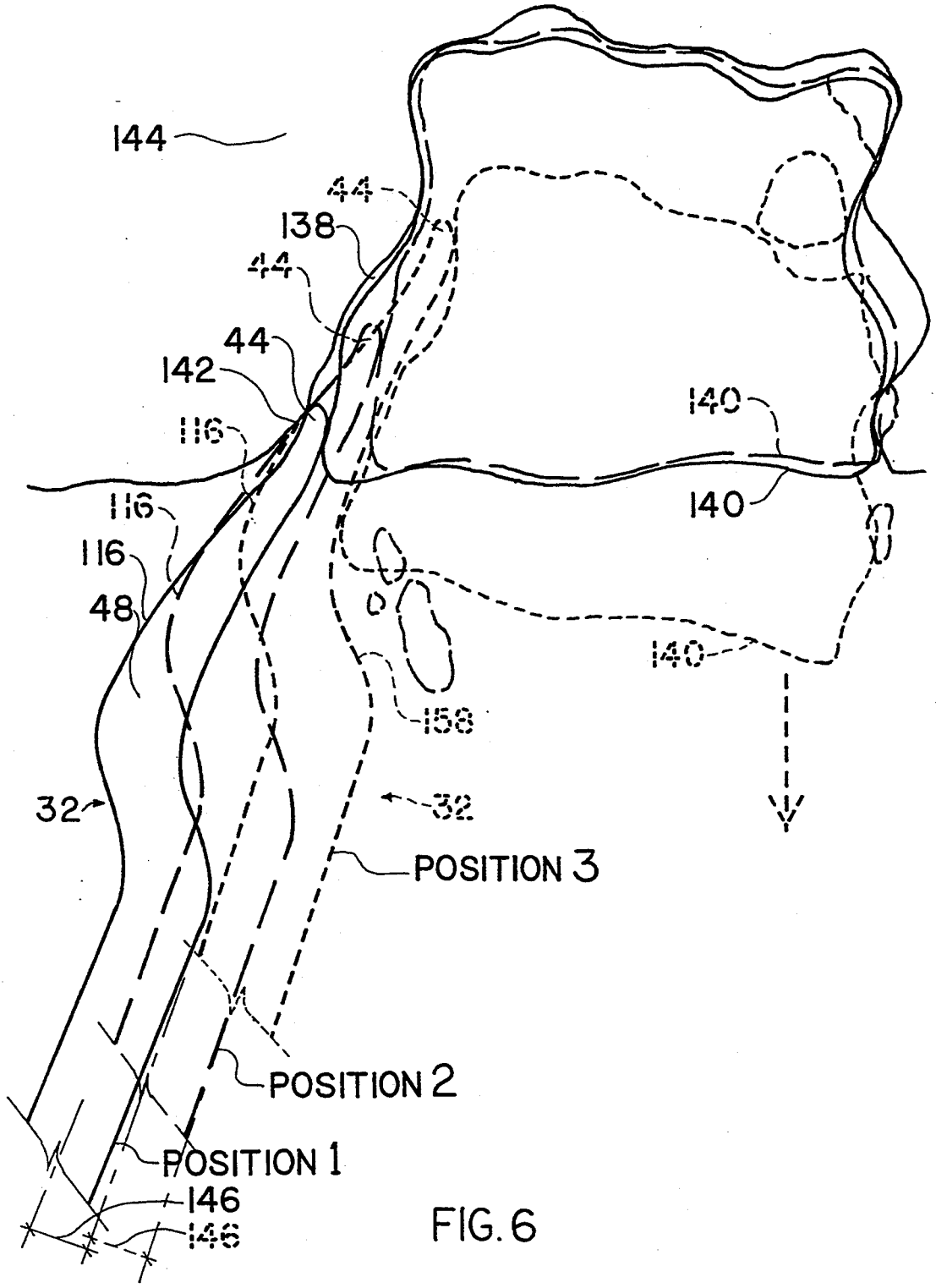
FIG. 6 is a detailed side view of the point in action.

During the scaling operation, an operator first visually probes the wall face in the gallery to locate any cracks from unstable rocks. He (or she) then inserts end extremity 112 (FIG. 6) of the scaling tool 32 in a crack and turns on the scaling bar by actioning the pneumatic control 104 by means of the trigger 36, while simultaneously giving the bar a push along first longitudinal axis 46 without any flexing effort, contrary to what would have been necessary for a tool having a wedge point without any clearance.

A lever effect is generated and increased gradually while the scaling tool 32 (FIG. 6) penetrates in crack 138. In position 1, illustrated in continuous lines, the interior support surface 126 of the scaling tool 32 pushes onto an unstable rock 140 while the back 116 props itself up 142 against rock face 144. The angular stem 48, by the hammering effect, inserts itself in crack 138 while the back 116 rests 142 at the same place (almost) on rock face 144. The clearance angle $\beta$ (FIG. 5) facilitates the penetration of the angular stem 48 while support angle $\alpha$ of the back 116 generates a moment acting on the unstable rock 140 (FIG. 6) caused by the lateral displacement of the first longitudinal axis 46 of the handle of the tool, up to position 2, illustrated in long discontinuous lines. Following this, the hammering pushes forward the angular stem 48 of the scaling tool 32 into the crack 138 while the back 116 still rests against the same place 142, augmenting, by the action of the angle $\alpha$ of the back 116, the amplitude of the moment and dislodging finally the unstable rock as in position 3, illustrated in short discontinuous lines. Finally the unstable rock is dislodged and falls to the ground. The guard ring 42 (FIG. 1) will deviate the fall of the rock, if it slides along the tool, far from the hands of the operator.

Let us analyze the lever effect generated by the scaling tool 32 (FIG. 2) upon the unstable rock. Two penetration cases are described to better present the axial (pushing) force component of the tool and of the operator radially transmitting force onto the unstable rock:

CASE 1: Points 148 to 150: horizontal displacement of the scaling tool 32 caused by the impact on the hit end 62 of piston 71 of the pneumatic hammer.

Points 148 à 152: corresponding displacement along back 116 of the scaling tool 32.

Points 152 à 150: corresponding vertical displacement of the scaling tool 32.

That is, to scale, segment 152 to 150 measuring 0.55 inch relative to segment 148 to 150 measuring two (2) inches, for an axial movement of two inches, the radial displacement is:

$$0.55/2=0.275 \text{ giving } 27.5\%$$

CASE 2: Points 148 to 154: horizontal displacement of 1"

Points 148 to 156: radial displacement of 1"

Points 156 to 154: vertical displacement of 0.375" that is 0.375/1=0.375 giving 37.5.

One of the specifications of the pneumatic hammer being the diameter D=0.787 inch of the piston and the air pressure P (used in mines) that is around 80 et 90 psi, one can approximate the pushing force Fp of the hammer of the scaling bar by multiplying the surface Ap of the piston by the supplied air pressure P:

$$F_p=P*A_p=P*\pi(D^2)/4=43.78 \text{ lbs}$$

with a pressure P=90 psi. Supposing a pushing force of about 40 lbs from the operator, combined with that of the hammer, one can estimate the total pushing force $F_t$ to be about 80 lbs.

Considering Case 2 because, in practice, when the scaling bar is turned on, part of the travel of the piston is transmitted to the scaling bar by rebound and the other part contributes to the penetration of the point of the tool into a crack in a rock by a amount varying from 25% to 50% of the displacement. Thus, the force on one side of an unstable rock, according to Case 2, would be:

$$37.5\%*80 \text{ lbs}=30 \text{ lbs.}$$

Considering a pivot forming a lever at a general distance of five (5) to six (6) inches on the line of action of the force of 30 lbs, one can estimate the moment generated on the unstable rock to be:

$$30 \text{ lbs}*5.5 \text{ inches}=165 \text{ lbs}*\text{in},$$

that is a moment in the order of 160 lbs*in. This moment is similar to the one generated by manual operators using a conventional non mechanized scaling bar, the operator being often at the end of his (or her) reach in an uncomfortable position. With the present invention that is not the case, the operator provides an axial force of around 40 lbs relative to the first longitudinal axis 46 of the handle of the mechanized scaling bar in an ideal and ergonomic position (FIG. 1). It is the shape of the convex back 116 (FIG. 5) of the scaling tool 32 that generates a moment upon the unstable rock without any flexing effort from the operator. The concave shape 130 and the clearance angle $\beta$ facilite the penetration while the displacement 146 (FIG. 6) and the widening of the angular stem augment the force against side 142 of the rock face and against the unstable rock 140. The elongated S-shape 54 (FIG. 2) follows the angular stem 48 and forces the unstable rock to dislodge itself by sliding into the interior 158 (FIG. 6) while the scaling tool 32 advances in the crack.

The combination of angle $\alpha$ (FIG. 5) of the back of the point of the tool and angle $\beta$ of the internal face relative to the axis of the handle and the penetration of the scaling tool 32 in a crack creates a lever effect, by the sole displacement of a piston, between the point 44 and the back 116 of the tool, circumferentially relative to the extremity 112 of the point 44 of the tool, the arms of the operator allowing at most an immediate dislodging of unstable rocks without moving or displacing one's body.

OTHER EMBODIMENTS

The combined effects of the interior bushing 69 and of the O-ring 78 minimize the vibrations transmitted to the operator by the mechanized scaling bar, protecting from the come and go movements of a pneumatic hammer. Moreover the fixed exterior handle 92 is threaded at its back extremity so as to receive ring 96 which is adapted to the hollow telescopic sleeve 102 all of which fixes the inner telescopic sleeve 102 to the exterior handle 92. Both the fixed exterior handle 92 and screw ring 96 comprise scored corrugations on all their respective lengths which improves the hold of the tool by the operator and the fixing of the telescopic sleeve, whatever the position of his hand on the handle.

I have found that the preferred distance, for optimum levering effect coupled with the convex back 116, between the first longitudinal axis 46 and the second longitudinal axis 114 falls in a range of between 0.75 and 1.25 cm.

A preferred embodiment and a minor variation of the subject invention is described herein. However, it will be understood that other embodiments and variations of the one described are possible within the scope of the invention which is limited only by the scope of the appended claims:

| Parts list | |
|---|---|
| 20 | gallery |
| 22 | unstable rocks |
| 24 | operator |
| 26 | unstable rock |
| 28 | mechanized scaling bar |
| 30 | impact device |
| 32 | scaling tool |
| 33 | penetrating portion |
| 34 | telescopic handle |
| 36 | trigger |
| 38 | hose |
| 40 | adaptor |
| 42 | guard ring |
| 44 | penetration point |
| 46 | first longitudinal axis |
| 48 | angular stem |
| 50 | third axis |
| 52 | length |
| 54 | S-shape |
| 56 | anvil |
| 58 | elongated body |
| 59 | abutting ring |
| 60 | junction end |
| 62 | hit end |
| 64 | top part (of the primary adaptor 66) |
| 66 | primary adaptor |
| 68 | vestibule |
| 69 | bushing |
| 70 | pneumatic hammer |
| 71 | piston |
| 72 | split stop ring |
| 74 | retaining coupling |
| 76 | retaining O-ring |
| 78 | cushioning O-ring |
| 80 | bolts |
| 82 | hexagonal wear ring |
| 83 | hexagonal section |
| 84 | nut |
| 86 | interior bushing |
| 90 | bolt |
| 92 | exterior telescopic sleeve |
| 94 | locking mechanism |
| 96 | screwed on ring |
| 98 | O-ring |
| 100 | tapered piece of soft rubber |
| 102 | hollow handle |
| 104 | pneumatic control |
| 110 | stop ring |
| 112 | rounded extremity |
| 114 | second longitudinal axis |
| 116 | convex back |
| 118 | concave portion |
| 120 | straight line passing by two points 122 and 124 respectively located on the concave portion 118 and on the convex back 116 of the angular stem 48 |
| 126 | concave face |
| 128 | convex portion |
| 130 | concave portion |
| . . . | right line passing by two points 132 and 134 respectively located on convex portion 128 and on concave portion 130 of face 126 |
| 136 | fourth axis |
| $\alpha$ | support angle |
| $\beta$ | clearance angle |
| $\tau$ | angle |

I claim:

1. A scaling tool for the dislodging of unstable rocks in galleries of subterranean mines, said scaling tool comprising an anvil and a penetrating portion generally in line along a common axis, said anvil being adapted to be hit by periodic displacement means acting on said anvil along said common axis and said penetrating portion being joined to said anvil, said anvil comprising: a generally circular elongated body with a first longitudinal axis, a hit end to receive an impact from said periodic displacement means, a junction end to connect to said penetrating portion, means disposed between said hit end and said junction end for non-rotatively sliding said elongated body, and retaining means to limit said sliding, said penetrating portion comprising:

a penetration point being disposed along a second longitudinal axis, said second longitudinal axis being parallel to said first longitudinal axis and laid at a distance from said first longitudinal axis, said penetration point having a free end, an angular stem being an extension of said penetration point in an opposing direction from said free end and comprising a third axis, a length and two sides, an S-shape at said junction end, said S-shape being also elongated, connecting said angular stem to said elongated body of said anvil at said junction end, said second and third axes forming an angle $\alpha$ between each other, a first side of said stem forming a convex back, adapted to form a wedge with said second longitudinal axis and a second side forming a concave face oriented toward said first longitudinal axis and forming a clearance angle $\beta$ and where said angle $\beta$ is smaller than said angle $\alpha$, the axial displacement of the elongated body of the anvil, the S-shape, the angular stem and the penetration point, when hit by said periodic displacement means, causing penetration between rocks and the forming of a lever for the dislodging of said rocks.

2. A scaling tool as defined in claim 1 comprising a polygonal section for non-rotative longitudinal sliding of said elongated body, said polygonal section having a length being about twice the diameter of said elongated body, and disposed at 25 to 40% of the distance between said hitting end and said junction end.

3. A scaling tool as defined in claim 2 wherein said polygonal section is a hexagonal section.

4. A scaling tool as defined in claim 3 wherein the value of angle $\alpha$ between said angular stem third axis and said second longitudinal axis lies in a range between 5° and 25°.

5. A scaling tool as defined in claim 4 where the preferred range of values of clearance angle $\beta$ is between 0° and 12°.

6. A scaling tool as defined in claim 1 wherein said distance between said first longitudinal axis and said second longitudinal axis is of half of the diameter of said elongated body.

7. A scaling tool as defined in claim 1 wherein said distance between said first longitudinal axis and said second longitudinal axis falls in a range of between 0.75 and 1.25 cm.

8. A mechanized scaling bar for use with a scaling tool for the dislodging of unstable rocks in galleries of subterranean mines, said scaling tool comprising an anvil and a penetrating portion generally in line along a common axis, said anvil adapted to be hit by periodic displacement means acting on said anvil along said common axis, said penetrating portion joined to said anvil, said anvil comprising: a generally circular elongated body with a first longitudinal axis, a hit end to receive an impact from said means for displacing, a junction end to connect to said penetrating portion, means disposed between said hit end and said junction end for non-rotatively sliding said elongated body, and retaining means to limit said sliding, said penetrating portion comprising:

a penetration point being disposed along a second longitudinal axis said second longitudinal axis being parallel to said first longitudinal axis and laid at a distance from said first longitudinal axis, said penetration point having a free end, an angular stem being an extension of said penetration point in an opposing direction from said free end and comprising a third axis, a length and two sides, an S-shape at said junction end, said S-shape being also elongated, connecting said angular stem to said elongated body of said anvil at said junction end, said second and third axes forming an angle $\alpha$ between each other, a first side of said stem forming a convex back, adapted to form a wedge with said second longitudinal axis and a second side forming a concave face oriented toward said first longitudinal axis and forming a clearance angle $\beta$ and where said angle $\beta$ is smaller than said angle $\alpha$, the axial displacement of the elongated body of the anvil, the S-shape, the angular stem and the penetration point, when hit by said periodic displacement means, causing penetration between rocks and the forming of a lever for the dislodging of said rocks;

wherein said periodic displacement means comprise a pneumatic hammer, provided with a piston adapted to be displaced axially toward said anvil onto said hit end, said mechanized scaling bar further comprising:

an envelope forming a primary adaptor adapted to receive said pneumatic hammer, said hit end and said polygonal section, a fixed exterior handle attached to said primary adaptor, a hollow inner telescopic sleeve, sliding within said fixed exterior handle, comprising means for passage of a fluid channeled to act on said hammer and means adapted to said handle to initialize the flow of said fluid.

9. A mechanized scaling bar as defined in claim 8 wherein said piston has a travel sensibly four (4) times longer than the displacement of said anvil.

10. A mechanized scaling bar as defined in claim 9 wherein the displacement of the anvil corresponds to a range of axial displacements of 20 to 35% of the displacement of said mechanical hammer and the radial displacement on said angular stem corresponds to a range of 25 to 40% of said axial displacement of the anvil, said radial displacement relative to said free end producing a lever.

11. A mechanized scaling bar as defined in claim 8 comprising a pneumatic control comprising a trigger, for the starting and stopping of said pneumatic hammer and installed at an inferior portion of said inner telescopic sleeve.

12. A mechanized scaling bar as defined in claim 8 comprising a fixed exterior handle receiving a sliding inner telescopic sleeve and comprising a locking mechanism installed along the central portion of said inner telescopic sleeve and comprising a screw on ring, a plastic O-ring and a tapered piece of rubber.

13. A mechanized scaling bar as defined in claim 8 wherein said envelope comprises means for retaining said scaling tool consisting of a split stop ring, a retaining O-ring, a retaining coupling, two cushioning O-rings, a bolt fixing said retaining coupling to said primary adaptor.

14. A mechanized scaling bar as defined in claim 8 wherein said pneumatic hammer comprises a telescopic handle fastened to said primary adaptor with a nut that pushes said primary adaptor against an interior bushing onto which is fixed a guard ring, thereby connecting the primary adaptor and the telescopic handle by means of bolts.

15. A mechanized scaling bar as defined in claim 8 comprising scored corrugations on said telescopic handle and on said screw on ring of said exterior telescopic sleeve, this having for goal to make the surface rougher and improve the hold upon said telescopic handle and said screw on ring of said telescopic sleeve.

* * * * *